US007806152B2

(12) United States Patent
Dalton et al.

(10) Patent No.: US 7,806,152 B2
(45) Date of Patent: Oct. 5, 2010

(54) AUTOMATED ICE BAGGING APPARATUS AND METHODS

(75) Inventors: Donald J. Dalton, Moultrie, GA (US); Roy Lavon Stripling, Moultrie, GA (US)

(73) Assignee: Ice House America LLC, Jacksonville, FL (US)

( * ) Notice: Subject to any disclaimer, the term of this patent is extended or adjusted under 35 U.S.C. 154(b) by 0 days.

(21) Appl. No.: 12/106,072

(22) Filed: Apr. 18, 2008

(65) Prior Publication Data

US 2008/0196788 A1 Aug. 21, 2008

Related U.S. Application Data

(63) Continuation of application No. 11/397,687, filed on Apr. 5, 2006, now Pat. No. 7,426,945, which is a continuation of application No. 11/110,924, filed on Apr. 21, 2005, now Pat. No. 7,104,291, which is a continuation of application No. 10/715,563, filed on Nov. 19, 2003, now Pat. No. 6,932,124.

(51) Int. Cl.
*B65B 1/30* (2006.01)

(52) U.S. Cl. ..... 141/83; 141/82; 141/314; 53/385.1; 53/469; 53/502

(58) Field of Classification Search ..... 141/82, 141/83, 114, 313–316; 53/502, 467–469, 53/385.1, 167

See application file for complete search history.

(56) References Cited

U.S. PATENT DOCUMENTS

| | | | |
|---|---|---|---|
| 1,206,088 | A | 11/1916 | Boatright |
| 1,857,881 | A | 5/1932 | Scott et al. |
| 2,074,351 | A | 3/1937 | Zeigler |
| 2,100,423 | A | 11/1937 | Zeiger |
| 2,330,186 | A | 9/1943 | Jetseck et al. |
| 2,502,161 | A | 3/1950 | Lilly |
| 2,969,650 | A | 1/1961 | Eschenburg et al. |

(Continued)

FOREIGN PATENT DOCUMENTS

| | | |
|---|---|---|
| CN | 201323844 | 10/2009 |

(Continued)

OTHER PUBLICATIONS

IPT 321-25, dated Feb. 18, 1998.

(Continued)

*Primary Examiner*—Gregory L Huson
*Assistant Examiner*—Jason K Niesz
(74) *Attorney, Agent, or Firm*—Haynes and Boone, LLP

(57) ABSTRACT

An automatic ice vending apparatus including a holding vessel formed with an aperture, the holding vessel being configured and dimensioned to receive and house ice pieces produced by an operatively associated ice supply, an ice metering device, and an ice transferring device at least partially disposed within the holding vessel that facilitates movement of ice pieces located therein in a first direction toward the aperture thereof, and movement of ice pieces in a second different direction from the aperture to the ice metering device, which is adapted and configured to meter a quantity of ice pieces into a readily transportable container. Methods and automated methods of delivering ice to consumer(s) are also included.

16 Claims, 7 Drawing Sheets

U.S. PATENT DOCUMENTS 2,986,897 A 6/1961 Howard
3,028,045 A 4/1962 Smith
3,119,518 A 1/1964 Eschenburg et al.
3,151,668 A 10/1964 Zimmerman
3,165,901 A 1/1965 Weil et al.
3,207,366 A 9/1965 Fiestel, Jr.
3,217,509 A 11/1965 Weil et al.
3,251,447 A 5/1966 Brown et al.
3,272,300 A 9/1966 Hoenisch
3,277,666 A 10/1966 Simmons
3,329,223 A 7/1967 Swanson et al.
3,406,871 A 10/1968 Hoenisch
3,543,811 A 12/1970 Lamka
3,580,416 A 5/1971 Hoenisch
3,610,482 A 10/1971 Steenburgh, Jr.
3,618,733 A 11/1971 Winsett
3,731,454 A 5/1973 Crabb
3,789,570 A 2/1974 Mullins, Jr.
3,796,349 A 3/1974 Weber
3,796,351 A 3/1974 Kohl et al.
3,807,193 A 4/1974 McKenney et al.
3,809,295 A 5/1974 Vitencz
3,858,765 A 1/1975 Landers
3,881,642 A 5/1975 Hoenisch
3,913,343 A 10/1975 Rowland et al.
3,918,266 A 11/1975 Gindy et al.
3,931,911 A 1/1976 Kohl
4,049,161 A 9/1977 Kohl
4,088,243 A 5/1978 Deveson
4,095,723 A 6/1978 Lerner
4,123,918 A 11/1978 Kohl et al.
4,132,049 A 1/1979 Mullins, Jr.
4,136,803 A 1/1979 Tobias et al.
4,139,029 A 2/1979 Geraci
4,177,621 A 12/1979 Powell, Jr.
4,189,063 A 2/1980 Matthiesen
4,227,377 A 10/1980 Miller
4,254,896 A 3/1981 Stanford et al.
4,277,002 A 7/1981 Christensen et al.
4,346,824 A 8/1982 Miller et al.
4,348,872 A * 9/1982 Hill ..... 62/459
4,368,608 A 1/1983 Ray
4,402,426 A 9/1983 Faulkner et al.
4,404,817 A 9/1983 Cox, III
4,417,671 A 11/1983 Kawasaki et al.
4,470,522 A 9/1984 Lents et al.
4,512,502 A 4/1985 Landers
4,513,892 A 4/1985 Koeneman et al.
4,612,779 A 9/1986 Hatton
4,619,117 A 10/1986 Ito
4,689,937 A 9/1987 Finan, Sr. et al.
4,694,661 A 9/1987 Landers
4,787,539 A 11/1988 Uchida
4,788,830 A 12/1988 Schreiner et al.
4,803,847 A 2/1989 Koeneman et al.
4,804,111 A 2/1989 Ricciardi et al.
4,846,381 A 7/1989 Kito et al.
4,878,523 A 11/1989 Balsamico et al.
4,921,149 A 5/1990 Miller et al.
4,942,983 A 7/1990 Bradbury
5,079,897 A 1/1992 Muller
5,088,300 A 2/1992 Wessa
5,097,897 A 3/1992 Watanabe et al.
5,109,651 A 5/1992 Stuart
5,112,477 A 5/1992 Hamlin
5,211,030 A 5/1993 Jameson
5,277,016 A 1/1994 Williams et al.
5,299,427 A 4/1994 Miller et al.
5,392,960 A 2/1995 Kendt et al.
5,440,863 A 8/1995 Toya et al.
5,458,851 A 10/1995 Schroeder et al.
5,473,865 A 12/1995 Tanaka et al.
5,503,198 A 4/1996 Becker
5,581,982 A 12/1996 Schroeder et al.
5,630,310 A 5/1997 Chadwell
5,660,506 A 8/1997 Berge et al.
5,667,108 A * 9/1997 Braun et al. ..... 222/181.1
5,708,223 A 1/1998 Wyss
5,806,576 A 9/1998 Sutherlin
5,822,955 A 10/1998 Woosley et al.
5,881,913 A 3/1999 Boulter
5,887,758 A 3/1999 Hawkes et al.
5,911,884 A 6/1999 Boulter
6,035,606 A 3/2000 Bussey, III et al.
6,093,312 A 7/2000 Boulter
6,112,539 A 9/2000 Colberg
6,266,945 B1 7/2001 Schroeder
6,354,338 B1 3/2002 Takemoto
6,418,701 B1 7/2002 Navarro
6,474,048 B1 11/2002 Metzger et al.
6,827,529 B1 12/2004 Berge et al.
6,894,232 B2 5/2005 Waggoner et al.
6,904,946 B2 6/2005 James
6,932,124 B2 8/2005 Dalton et al.
7,104,291 B2 9/2006 Dalton et al.
7,205,016 B2 4/2007 Garwood
7,426,945 B2 9/2008 Dalton et al.
2004/0216481 A1 11/2004 James et al.
2007/0267086 A1 11/2007 Dunn

FOREIGN PATENT DOCUMENTS

GB 1082400 9/1967
JP 5108947 4/1993
JP 6064602 3/1994
JP 6064632 3/1994
JP 6187567 7/1994
JP 2004077027 3/2004

OTHER PUBLICATIONS

Civil Docket for Case No. 3:05-cv-01294-VMC-TEM, *Ice House America, LLC* v. *Redico, Inc. et al.*, filed Dec. 20, 2005.
Complaint against Redico, Inc., Innovative Packaging Technologies, Inc., Ice Cube Company, Richard J. Soderman, and Jeffrey Poore, dated Dec. 20, 2005.
Amended Complaint against Innovative Packaging Technologies, Inc., Ice Cube Company, Richard J. Soderman, and Jeffrey Poore, dated Jan. 25, 2006.
Answer to Amended Complaint and Counterclaims by Defendants 1PT Soderman & Poore, Feb. 10, 2006.
Civil Docket for Case No. 2:06-cv-14047-JEM, *Ice House America* v. *L & T Ice, LLC*, filed Feb. 27, 2006.
Plaintiff's Reply and Affirmative Defenses to Defendant's Counterclaims, dated Apr. 26, 2006.
Settlement Agreement by and between Ice House America, LLC, and M. Rutledge Inc. and Mark Rutledge, dated Jul. 2007.
Notice of Withdrawal of Motion by Ice House America, LLC, M. Rutledge Inc., and Mark Rutledge re Motion for Summary Judgment filed by M. Rutledge Inc., Mark Rutledge, dated Jul. 25, 2007.
License and Settlement Agreement by and between Ice House America, LLC and L&T Ice, LLC, dated Aug. 2006.
Invoices, drawings, and pictures produced by Bob Kelly under cover letter dated Oct. 2, 2007, in response to a subpoena issued by Ice House America.
Notice of Filing Expert Report of Benjamin Miller in support of Markman Brief on Claim Construction, by Ice House America, LLC, filed Oct. 3, 2007.
Notice of Filing the Declaration of Dalbert U. Shefte in Support of Markman Brief on Claim Construction, by Ice House America, dated Oct. 3, 2007.
Notice of Filing the Declaration of Benjamin Miller in support of Markman Brief on Claim Construction, by Ice House America, LLC, dated Oct. 8, 2007.

Notice of Filing Corrected Markman Brief on Claim Construction and Supporting Memorandum of Law, by Ice House America, LLC, dated Oct. 8, 2007.

Motion in Limine to Exclude All Evidence of Defendants' "Ordinary Skill in the Art" and to Strike Portions of Defendants' Markman Submission, and Incorporated Memorandum of Law by Ice House America, LLC, filed Oct. 22, 2007.

Response in Opposition re Motion in Limine to Exclude All Evidence of Defendants' "Ordinary Skill in the Art" and to Strike Portions of Defendants' Markman Submission, and Incorporated Memorandum of Law filed by Innovative Packaging Technologies, Inc., Richard J. Soderman, and Jeffrey Poore, dated Nov. 8, 2007.

Notice of Prior Art Relevant to Validity of U.S. Patent No. 6,932,124 by Innovative Packaging Technologies, Inc., Richard J. Soderman, and Jeffrey Poore, dated Jan. 11, 2008.

Defendants' Case Dispositive Motion for Summary Judgment With Incorporated Memorandum of Law; Case 3:05-cv-01294-MMH-TEM; Doc. 128; Sep. 9, 2008; pp. 8, 10-15.

U.S. Appl. No. 12/767,903, filed Apr. 27, 2010, Dunn.

Motion for Summary Judgment with Incorporated Supporting Memorandum of Law; Case 3.05-cv-01294-MMH-TEM; Doc. 64; Jun. 7, 2007.

Defendants' Case Dispositive Motion for Summary Judgment With Incorporated *Amended* Memorandum of Law; Case 3:05-cv-01294-MMH-TEM; Doc. 131; Sep. 15, 2008.

Plaintiff's Opposition to Defendant's Case Dispositive Motion for Summary Judgment, Case 3:05-cv-01294-MMH-TEM; Doc. 139; Oct. 7, 2008.

Order Granting Permanent Injunction; Case 3:05-cv-01294-MMH-TEM; Doc. 149; Nov. 24, 2009.

* cited by examiner

AUTOMATED ICE BAGGING APPARATUS AND METHODS

CROSS-REFERENCE TO RELATED APPLICATIONS

This application is a continuation of U.S. application Ser. No. 11/397,687, filed Apr. 5, 2006 now U.S. Pat. No. 7,426,945, which is a continuation of U.S. application Ser. No. 11/110,924, filed Apr. 21, 2005, now U.S. Pat. No. 7,104,291, which is a continuation of U.S. application Ser. No. 10/715,563, filed Nov. 19, 2003, now U.S. Pat. No. 6,932,124, the contents of each of which are incorporated herein in their entirety by express reference thereto.

FIELD OF INVENTION

The present invention relates to an automatic ice vending and bagging machine, and methods of automatically providing ice pieces to consumers, that includes a holding vessel configured and dimensioned to receive and house ice pieces produced by an operatively associated ice supply, an ice metering device, and an ice transferring device at least partially disposed within the holding vessel that facilitates movement of ice pieces located in the holding vessel in a first direction toward an aperture thereof and movement of ice pieces in a second different direction from the aperture to the ice metering device, which is adapted and configured to meter a quantity of ice pieces into a readily.

BACKGROUND ART

Ice bagging machines, ice vending machines, and ice bagging and vending machines are known in the art in general. Many different forms of these machines are in commercial use or are described in the prior art.

U.S. Pat. No. 4,368,608 discloses an automatic ice bagger that freezes a measured amount of water into cubes. The cubes are dropped directly into a bag placed under a chute. The bag is heat sealed, and then released and dropped into a cold storage bin that stores the filled bags.

U.S. Pat. No. 4,689,937 discloses an article bagging unit useful in bagging ice. A bag, positioned to receive ice cubes, is partially opened by an air blower and then fully opened by two pairs of fingers. The bag is filled with ice cubes and heat sealed.

U.S. Pat. No. 4,878,523 discloses an ice measuring and dispensing machine which includes an ice supply hopper, a housing having three measuring and dispensing chambers which continuously rotate about a vertical axis, and a discharge chute. Additionally, a hammering device makes repeated, jarring contact with the wall of the chambers to vibrate the chambers and prevent the collection of ice therein.

U.S. Pat. No. 5,079,897 discloses a device for transferring bags from a volumetric bagger to a bag-closing machine. A fan automatically opens a bag. The required amount of ice is transferred from a hopper to the bag, and then removed to the bag transfer device. The bag transfer device then brings the bag to a bag-closing machine where the bag may be closed by any suitable method, such as stitching or heat sealing.

U.S. Pat. No. 5,109,651 discloses an ice bagger comprising an ice collecting zone, which has a water drain, and an auger positioned below and in communication with the ice collecting zone and in communication with a separated ice delivery and bagging zone. The ice bagging apparatus is combined with an ice making apparatus and a bagged ice storage zone.

U.S. Pat. No. 5,277,016 discloses a method and apparatus for bagging ice cubes produced by a plurality of cubers with only one bagger when the cubers are stacked side-by-side with the ice produced by each cuber falling into one of two hoppers. The ice is moved from each hopper alternately to the bagger. There, each batch of ice cubes is dropped into a bag, sealed, and moved to a bag storage bin positioned below the bagger.

U.S. Pat. No. 5,458,851 discloses an automatic ice bagger with a self-contained sanitizing system. The sanitizing system periodically activates to sanitize the ice hopper. A flow of water is directed to the hopper to melt the ice in the hopper and to flush the melt water to a reservoir.

U.S. Pat. No. 5,581,982 discloses a method for automatically bagging ice using a timer and multipositional electronic scale. Ice is delivered to a bag until a sensor provides a signal indicating that the bag is full. The bag is then sealed, released, and delivered into an ice bag storage bin.

U.S. Pat. No. 5,630,310 discloses an ice bagger comprising an ice maker, an ice bagging unit, which includes an automatic sanitation system, and a merchandiser. The ice maker delivers particulate ice into a hopper housed within the ice bagging unit. The ice bagging unit includes a bag carrier which retrieves a bag from a bag supply and opens the bag underneath a delivery chute communicating with the hopper via an auger. A scale supports the bag during its filling to measure the weight of the ice delivered into the bag from the hopper. A heating element then activates to seal the bag closed.

U.S. Pat. No. 5,708,223 discloses a remote sensing ice merchandiser. Bagged ice is presented to the consumers in an insulated cabinet having a storage chamber accessible through a front door. Photo-electric eyes mounted within the cabinet detect when the level of bagged ice falls within a certain level and transmits this information to an inventory control station.

U.S. Pat. No. 6,112,539 discloses a device for making, bagging, and delivering a heat-sealed bag of ice to a consumer. Ice is supplied to a hopper and then dispensed into a bag, which is then heat-sealed and delivered to the customer.

U.S. Pat. No. 6,266,945 discloses an ice supply system, which includes a dispenser system, an ice bagger system, and an ice transport system for providing a supply of ice. The ice transport system is operatively linked with the dispenser system for transporting ice to the dispenser system and with the ice bagger system for transporting ice to the ice bagger system The ice supply system includes a dispenser system, which preferably includes a dispenser unit for facilitating the dispensing of a desired beverage and accompanying ice. The dispenser unit includes an ice bin for receiving and storing ice received from an ice making system. The ice supply system also includes an automatic ice bagger for providing individual bags of ice to consumers. A vacuum pump is used to induce movement of ice along the ice supply system.

Often, pre-bagged ice bags, whether made offsite and shipped to a retail site or bagged onsite and stored in bagged form, are frozen hard and are days and weeks old before a consumer can obtain them through a dispenser box. Such pre-bagged hard ice is stale and can undesirably take on odors during storage or transport. Also, pre-bagged ice often agglomerates into chunks of ice that are too large for consumers to readily use, e.g., they will no longer fit into a cup or pitcher, which forces the consumer to take additional efforts to reduce the ice agglomerate size before use. Thus, it is desired to provide an apparatus and method whereby a consumer can receive fresh-bagged ice conveniently, at any time of the day or night. It is also desired that the source of ice be made onsite to avoid the cost, expense, and time-lag of transporting pre-bagged ice to a retail site where consumers may purchase it.

SUMMARY OF THE INVENTION

The invention encompasses an ice vending apparatus that includes a holding vessel formed with an aperture, the holding vessel being configured and dimensioned to receive and house ice pieces produced by an operatively associated ice supply, an ice metering device, and an ice transferring device at least partially disposed within the holding vessel that facilitates movement of ice pieces located therein in a first direction toward the aperture thereof and that facilitates movement of ice pieces in a second different direction from the aperture to the ice metering device, which is adapted and configured to meter a quantity of ice pieces into a readily transportable container.

In preferred embodiment, the first direction is substantially horizontal. In a more preferred embodiment, the first direction is angled no more than about 20 degrees from the horizontal. In another embodiment, the ice supply is configured and adapted to deposit ice pieces into the holding vessel to replenish a portion of ice pieces removed through the aperture. In yet another embodiment, the ice metering device includes a weighing device located vertically above the aperture, the second direction being upwardly angled between the aperture and the weighing device.

In a further embodiment, the readily transportable container is a fully formed, discrete, plastic bag including an open end in which to dispose the selected quantity of ice pieces and a second permanently closed end. In a preferred embodiment, the apparatus further includes a fan that operates to blow open the open end of the bag to facilitate disposing ice pieces therein. In another preferred embodiment, the apparatus further includes a positioning device configured and adapted to position the bag so the open end can receive ice pieces. In yet another preferred embodiment, the apparatus further includes a closing device configured and adapted to releasably fasten each open end to seal each bag.

In one preferred embodiment, the apparatus further includes a downwardly angled surface associated with the ice metering device to facilitate delivery of each container therefrom to a consumer. In yet another embodiment, the apparatus is configured and adapted to deliver a substantial quantity of automatically bagged ice pieces in rapid succession by providing at least 100 readily transportable containers in no more than about 30 minutes.

The invention also encompasses an ice vending apparatus that includes a holding vessel formed with an aperture, the holding vessel being configured and dimensioned to receive and house ice pieces produced by an operatively associated ice supply, a container filling station, and an ice transferring device at least partially disposed within the holding vessel, with the ice transferring device facilitating movement of ice pieces located therein in a first direction toward and through the aperture thereof, and in a second different direction to the container filling station where a selected quantity of ice pieces is placed into a readily transportable container.

In one embodiment, the container filling station includes a weighing device that is operatively associated with the ice transferring device and that meters a selected quantity of ice pieces into each readily transportable container. In yet another embodiment, the ice transferring device includes a first transport mechanism disposed within the holding vessel that assists in moving ice pieces located within the holding vessel toward the aperture thereof. In a preferred embodiment, the first transport mechanism moves ice pieces located within the holding vessel in a substantially horizontal direction, and in a downwardly angled direction relative to the vertical, toward the aperture in the holding vessel. In another preferred embodiment, the ice transferring device further includes a second transport mechanism located outside of the holding vessel which moves ice pieces from the aperture to the container filling station.

In another preferred embodiment, the second transport mechanism includes a vessel positioned to receive ice pieces emitted from the aperture, a first transport device located within the vessel to move ice pieces toward an end thereof, and a second transport device positioned between the end of the vessel and the container filling station to move ice pieces from the catch vessel to the container filling station. In another embodiment, the aperture extends across a portion of a side of the holding vessel so as to facilitate movement of ice pieces onto the first transport device. In yet another embodiment, the holding vessel is capable of housing a quantity of ice pieces having a weight of at least about 2,000 pounds. In yet a further embodiment, the apparatus is configured and adapted to deliver an ice-filled container to a purchaser within a time period in the range of about 4 seconds to 20 seconds from the time of receipt of payment.

The invention also encompasses an automated ice vending machine that includes a holding vessel having an aperture sized and dimensioned to permit ice pieces therethrough, the holding vessel being capable of housing a quantity of ice pieces having a weight of at least about 2,000 pounds which are produced by an operatively associated ice supply that operates to replenish a portion of removed ice pieces or to otherwise provide ice pieces, a container filling station, and an ice transferring device having a first portion located within the holding vessel that facilitates moving ice pieces in a substantially horizontal direction toward the aperture thereof, a second portion located at least partially within the holding vessel and oriented at an angle relative to the vertical that assists in moving ice pieces from the interior of the holding vessel downward and through the aperture thereof, and, a third portion located outside of the vessel which moves ice pieces emitted from the aperture upwardly to the container filling station, the ice transferring device facilitating replenishment of the container filling station with ice pieces from the holding vessel.

Moreover, the invention encompasses methods of delivering ice pieces to a consumer by providing a holding vessel capable of housing a quantity of ice pieces weighing at least about 2,000 pounds, providing a container filling station which receives ice pieces from the holding vessel, moving ice pieces housed within the holding vessel toward and through an aperture thereof, and separately transferring ice pieces emitted from the aperture to the container filling station to replenish the supply of ice pieces at the container filling station.

In one embodiment, the method further includes activating the container filling station in response to receipt of a payment by the consumer to dispense a selected amount of ice pieces into a readily transportable container. In another embodiment, activating the container filling station includes dispensing the ice pieces into the readily transportable container while weighing the container as it is filled so that the dispensing is terminated when a pre-selected weight of ice pieces is disposed in the container. In yet another embodiment, moving the ice pieces toward and through the aperture and separately transferring ice pieces are not concurrent. In a further embodiment, activating the container filling station includes metering the selected amount of ice pieces into the readily transportable container, which includes a bag, the bag being first opened at one end to facilitate receiving the ice pieces and then being sealed after receipt of the ice pieces and delivered to the consumer.

The invention further encompasses an automated method of delivering freshly packaged ice pieces to a consumer by providing a holding vessel capable of housing a quantity of ice pieces weighing at least about 2,000 pounds that are produced by an operatively associated ice supply, providing a container filling station which receives ice pieces from the holding vessel, activating the container filling station to dispense a selected amount of ice pieces into a readily transportable container, and delivering to the consumer an ice-filled container within a time period in the range of about 4 seconds to 20 seconds from receipt of payment from the consumer.

In one embodiment, the method further includes transferring ice pieces from the holding vessel to the container filling station to replenish the supply of ice pieces at the container filling station.

The invention also encompasses an automated method of delivering freshly bagged ice pieces to a consumer by receiving payment from the consumer in an amount corresponding to a pre-selected amount of ice pieces, and delivering the amount of ice pieces automatically to the consumer in less than about a minute from the time of receipt of payment, wherein the ice pieces are supplied from an operatively associated holding vessel that is replenished with ice pieces from an operatively associated ice supply to ensure sufficient availability of ice pieces for purchase.

In one embodiment, the delivering includes depositing the pre-selected amount of ice pieces in a readily transportable container before delivery to the consumer. In another embodiment, the ice pieces are delivered in about 4 seconds to 20 seconds. In yet a further embodiment, delivering the ice pieces includes depositing a plurality of ice pieces in a readily transportable container that is still open at an end, and separately providing a closing device to the consumer if it is desired to secure the open end of the container.

The invention also encompasses a method of automatically delivering ice pieces to a plurality of successive consumers upon receipt of a payment by each, by providing a holding vessel capable of housing a quantity of ice pieces weighing at least about 2,000 pounds, providing a container filling station which receives ice pieces from the holding vessel, and activating the container filling station in response to receipt of the payment by each successive consumer so as to dispense a selected amount of ice pieces to each consumer in rapid succession so that at least about 100 16-pound or 20-pound containers of ice pieces are delivered in no more than about 30 minutes before the holding vessel requires replenishment from an operatively associated ice supply.

In one embodiment, the activating includes providing about 300 to 1000 containers of ice in a 24-hour period, with each container being provided in under about a minute in response to payment by each of the consumers. In yet another embodiment, the activating includes transporting ice pieces in a first direction from within the holding vessel to a position outside the holding vessel, and in at least a second direction from the position outside the holding vessel to the container filling station.

The invention additionally encompasses an automated ice vending machine that includes a means for receiving a plurality of ice pieces provided by an ice supply, a means for moving the ice pieces in a first direction within the means for receiving to an aperture thereof, a means for moving the ice pieces in a second different direction from adjacent the aperture to a means for metering, and a means for metering that is configured and adapted to dispense a pre-selected quantity of ice pieces into a readily transportable container.

In other aspects of the invention, the invention relates to an automated ice vending apparatus including a holding vessel configured and dimensioned to contain sufficient ice pieces to provide a constant supply for an indeterminate time, and an ice transferring device positioned in the holding vessel and configured and adapted to transport a portion of the ice pieces in a substantially horizontal direction to remove the portion through an aperture of the holding vessel to a weighing device, whereby the weighing device meters out a portion of ice pieces and deposits the portion into a readily transportable container. In one embodiment, the holding vessel is sized and configured to contain about 2,000 to 20,000 pounds of ice pieces and the ice transferring device includes a first transport mechanism operatively associated with a bottom surface of the holding vessel that moves the ice pieces in the substantially horizontal direction and a second transport mechanism at an end of the holding vessel that is inclined and that moves the ice pieces at the end in a vertical direction and in the same horizontal direction as the first transport mechanism to facilitate transfer of the portion of ice pieces through the aperture and out of the vessel.

In one embodiment, the holding vessel is chilled to maintain the ice pieces at a temperature of lower than about 34 degrees Celsius. In another embodiment, the apparatus further includes an ice making device including a water source that is operatively associated with the holding vessel so that ice pieces are automatically produced thereby and disposed in the holding vessel. In another embodiment, the readily transportable containers are fully formed, hanging plastic bags including an open end that is closed after the metered or weighed portion is deposited therein. In another embodiment, the apparatus further includes a fan that operates to blow open the unsecured end of each bag to facilitate filling of the bag with the metered portion of ice pieces. In yet another embodiment, the apparatus further includes a positioning device configured and adapted to position the bag so the open end can receive the metered portion of ice pieces, a closing device configured and adapted to releasably fasten each open end to seal each bag, or both.

In another embodiment, the apparatus further includes a downwardly angled surface to facilitate delivery of each filled, readily transportable container to the consumer. In yet another embodiment, the ice transferring device further includes an upwardly directional ice transport device operatively positioned and configured to receive the portion of ice pieces from a location adjacent the aperture and to transport the portion in an upwards direction to a weighing device. Preferably, the upwardly directional ice transferring device can include an auger, an elevated conveyor, or a conveyor having a plurality of scoops thereon, or any combination thereof.

In another embodiment, the ice transferring device includes an ice sweep that begins at a starting position, moves in a substantially horizontal direction to facilitate transfer of the portion of the ice pieces to a position outside the holding vessel, and then returns to the starting position. In another embodiment, the second transport mechanism includes a plurality of projections disposed along the inclined portion thereof to facilitate movement of the ice pieces from the holding vessel through the aperture. In a preferred embodiment, the first transport mechanism including an ice sweep that moves in a substantially horizontal direction to transfer a portion of the ice pieces from the holding vessel to a position adjacent the second transport mechanism. Preferably, the ice transferring device includes a substantially horizontally disposed continuous loop mechanism and an inclined continuous loop device that operate together to first move the ice substantially horizontally toward the aperture and then at an angle downwards to and through the aperture in the holding vessel.

In another embodiment, the apparatus includes a substantially horizontal transport device that moves ice pieces transversely from adjacent the aperture, a second vessel that acts as a receiving bin that holds the ice pieces received from the aperture, or both, to be moved upwards to the weighing device by an upwardly directional ice transport device.

The invention also relates to a method for automatically delivering a plurality of pre-weighed ice pieces to a consumer, which includes automatically providing a plurality of loose ice pieces from a water source to a storage zone, holding a sufficient amount of ice pieces in the storage zone to provide a constant supply of loose ice pieces over an indeterminate period of time, weighing a pre-selected portion of the ice pieces, and depositing the pre-selected portion of the ice pieces into a readily transportable container.

The method also includes opening an end of each readily transportable container to facilitate depositing the portion of ice pieces therein, such as with a fan. In another embodiment, the method further includes transporting a plurality of ice pieces out of the storage zone, wherein the transporting includes moving the ice pieces in a substantially horizontal direction, raising an end of the storage zone above a second opposite end, pushing or pulling the plurality of ice pieces, or any combination thereof, so the ice pieces are removed from the storage zone to be weighed. In yet another embodiment, the method includes releasably securing an open end of the readily transportable container. In a preferred embodiment, the releasably securing includes stapling or tying the open end of the container.

Preferably, the consumer must provide sufficient payment before the weighing and depositing of ice pieces into a readily transportable container. Preferably, it takes about 4 to 20 seconds to take ice from the storage zone and provide it into the readily transportable container.

BRIEF DESCRIPTION OF THE DRAWINGS

Further features and advantages of the invention can be ascertained from the following detailed description that is provided in connection with the drawing(s) described below.

DETAILED DESCRIPTION OF THE PREFERRED EMBODIMENTS

Figure 1:
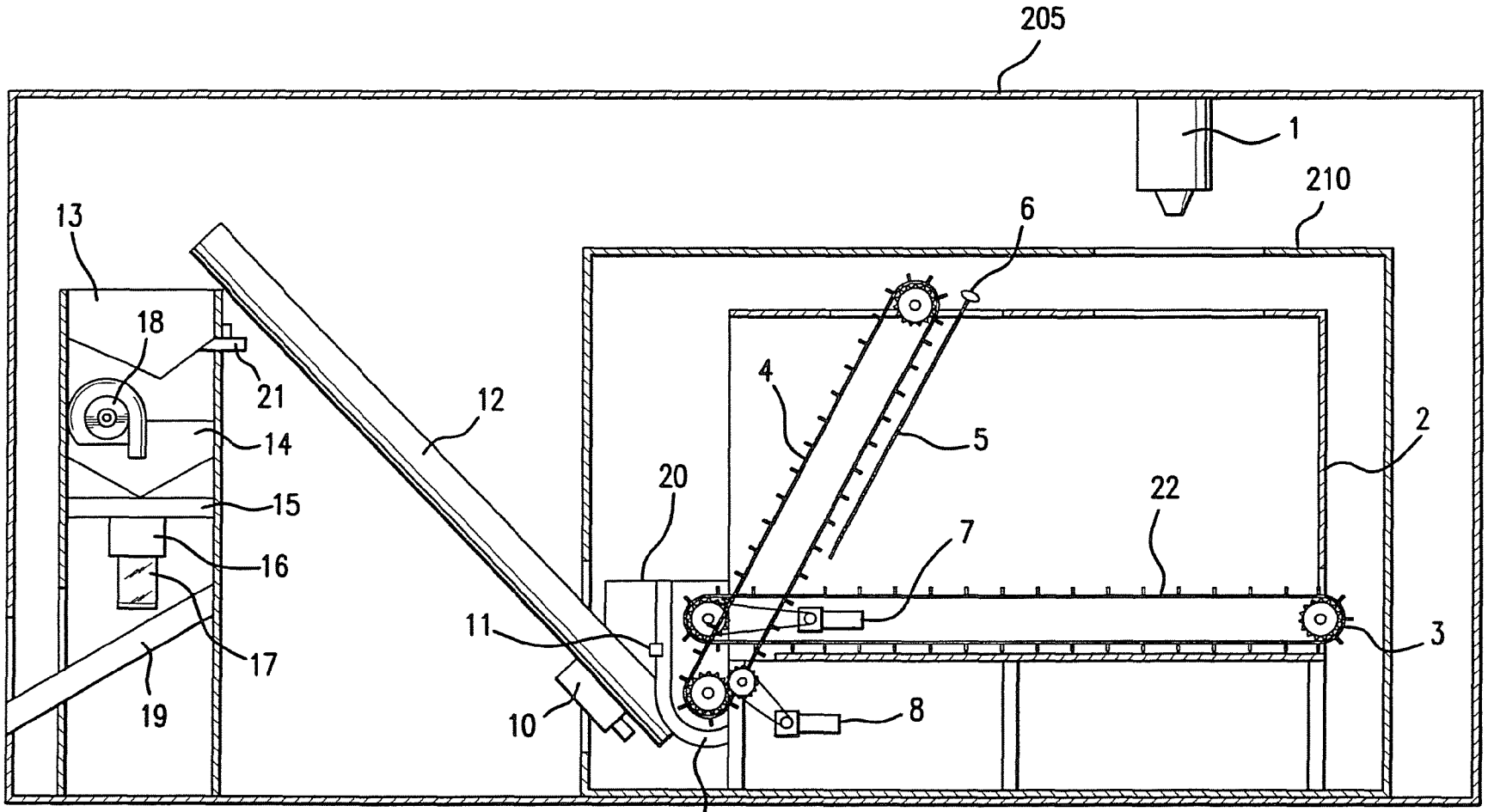
FIG. 1 shows a preferred embodiment that includes a device that substantially horizontally transports ice pieces from the holding vessel to the upwardly directional transporting device according to the invention.

An automated, fresh-bagged ice vending machine has now been invented that advantageously provides an apparatus, fresh-bagged ice, and methods for operating the apparatus that have been long desired in the ice vending art. The present invention advantageously can provide a constant supply of ice pieces over an indeterminate time to consumers by making and bagging ice on-site and on demand by the consumer(s). Such freshly bagged ice tends to minimize or avoid the staleness problems of pre-bagged hard ice, and can minimize or avoid undesirable odors by avoiding lengthy storage or time-consuming transport between the ice manufacturing and the bagging. Another potential benefit of the present invention is that containerized ice can be provided on-site, thereby avoiding the expense of transporting ice pre-bagged at a second location. The ice provided by the apparatus and process of the invention also minimizes agglomerates of ice that are too large for consumers to readily use, e.g., they will no longer fit into a cup or pitcher.

The present invention can accomplish this by providing a holding vessel configured and dimensioned to contain a significant quantity of ice pieces, e.g., greater than about 500 pounds, that provides a constant supply of ice pieces on demand in containerized form over an indeterminate period of time. Preferably, the holding vessel is sized and configured to contain at least about 2,000 pounds of ice pieces to about 20,000 pounds, preferably about 4,000 to 12,000 pounds. Since the apparatus optionally, but preferably, includes an ice making device, preferably an automatic ice making device attached to a water source, ice pieces can be provided in a sufficient quantity to replenish ice pieces that are removed from the holding vessel upon purchase by consumer(s). The automated vending apparatus of the invention can be arranged to provide about 300 to 1000 bags of ice in a 24-hour period, preferably about 400 to 600 bags. These bags are typically either 16 pound or 20 pound sizes. Other suitable container sizes can be selected, as well. In addition to the holding vessel and optional ice making device, the apparatus further includes an ice transferring device operatively associated with the holding vessel that is configured and adapted to transport a portion of the ice pieces in a substantially horizontal direction to remove the portion out of an aperture of the holding vessel. Optionally, but preferably, the apparatus further includes an upwardly directional ice transport device operably positioned and configured to receive the ice pieces from the aperture that can bring the ice pieces from a position adjacent to the aperture upwards to a weighing device 21. The apparatus includes the weighing device 21, which meters out a pre-selected portion of ice pieces and deposits the portion into a readily transportable container for use by the consumer. Preferably, the entire apparatus operates automatically with human intervention arising only when the consumer provides payment to the vending apparatus to initiate the bagging of the pre-selected portion of ice pieces in the paid-for amount, and as needed to refill a supply of empty containers that are stored as part of the apparatus into which ice pieces are disposed during operation.

To facilitate the automation of the inventive apparatus, a programmable logic control ("PLC") can be used to control a portion or all of the apparatus, including the initiation, duration of operation, and termination of each operation. For example, the PLC can instruct the motors that supply the power for the moving parts of the apparatus when to start and stop, and for how long to run. The payment system of the apparatus is operatively associated with the PLC, as are various limit switches or other input devices that provide input to the PLC so it can determine when sufficient ice has been transported to any given part of the apparatus.

Referring to FIG. 1, one can see how a preferred embodiment of the present invention operates. The apparatus 205 can either provide a single size container of ice pieces or provide a selection of two or more sizes. A consumer can select the amount of ice, if applicable, such as by pressing a suitable button and by providing proper payment for the desired size, e.g., 16 pound container, 20 pound container, or the like, or simply by providing proper payment to the apparatus for the desired or pre-selected size. In addition, the consumer has the choice of purchasing bagged ice or bulk ice, which may be placed in any suitable container, such as a cooler. Payment may be by any suitable payment receipt device operatively associated with the apparatus, including a credit card reader, bill reader, coin validator, or the like. The apparatus usually contains a coin validator into which a consumer can place the correct value of coins. A digital screen or digital readout (not shown), which includes directions as to how to use the apparatus to provide ice as well as indicating an "out of order" state if applicable, is preferably located adjacent or as part of the coin validator.

The holding vessel 2 must be sufficiently insulated to retain a majority of the ice in solid form so as to minimize or avoid substantial melting of the ice. The holding vessel 2 is preferably insulated from the environment by insulation chamber 210. While some loss of ice in the form of melt runoff can generally occur, and the apparatus preferably is operatively associated with a drain to channel the runoff away from the ice, it is more economical to retain as many ice pieces as possible in a frozen state. In a preferred embodiment, the holding vessel 2 is a chilled vessel 2 that includes a refrigeration unit (not shown) to keep the temperature in the vessel 2 below about 38° F., preferably below about 36° F., and more preferably below about 34° F. In a more preferred embodiment, the chilled vessel 2 includes a suitable freezer device (not shown) to maintain a temperature of no greater than about 32° F.

Preferably, sufficient ice pieces are already present in the holding vessel 2 when payment is validated. The ice maker 1 can be operatively linked to an ice demand system (not shown) of any type that suitably detects when additional ice pieces are required in the holding vessel 2 and triggers the ice maker 1 to produce more ice pieces. The ice maker 1 is preferably located outside of the insulation chamber 210 to minimize the amount of space required to be insulated, and to inhibit freezing of the ice maker components or the water therein being used to make ice. The ice demand system can simply make sufficient ice to replenish the amount purchased, thereby returning the ice quantity in the holding vessel 2 to an original level. Alternatively, the ice demand system can be arranged to initiate ice maker 1 at the time of payment to make ice to replenish the amount paid for or delivered. Preferably, an ice quantity detector, such as an optical-electronic system, can be disposed above or at the top of the holding vessel 2 or embedded within the sides thereof to detect when the ice level is sufficiently low, and the ice demand system can then automatically trigger ice production by the ice maker 1. Another possible alternative is to include a weighing device 21 in conjunction with the holding vessel 2 itself, to determine when more ice manufacture is required. This could, for example, include a simple scale device or strain gauges on the frame, base, or sides of the holding vessel 2 connected with an integrated circuit or computing apparatus to automatically calculate weight based on the strain on the frame, base, or sides of the holding vessel 2. An agitation motor (not shown) can be located on the exterior of the holding vessel 2 and be operatively associated with an agitation device within or adjacent to the holding vessel to inhibit or prevent the ice pieces therein from freezing together and hardening. The apparatus advantageously includes an ice transferring device 3 including a first transport mechanism 22 positioned in the holding vessel and configured and adapted to transport a portion of the ice pieces in a substantially horizontal direction to facilitate removing the portion out of an aperture of the holding vessel. In a preferred mode, the ice transferring device 3 pushes the ice in a substantially horizontal direction toward the aperture, and typically in conjunction with an inclined second transport mechanism, facilitates transport of the ice pieces through the aperture in the holding vessel 2. The first transport mechanism can include, for example, a conveyor belt, a chain, a plurality of side-by-side rollers disposed transverse to the substantially horizontal direction, or the like, or any combination thereof. Preferably, a chain is included. The first transport mechanism is preferably a continuously operable loop, and is preferably motorized.

Optionally, but preferably, the ice transferring device further includes a second transport mechanism that is operatively associated with the first transport mechanism and that operates to move ice pieces from the mass of ice pieces in the holding vessel at an angle downwards into and through the aperture. The mass of ice pieces is first transported substantially horizontally adjacent to the second transport mechanism, which then agitates the ice pieces sufficiently to move them in the downwardly angled direction. For example, the second transport mechanism can include an ice rake chain 4 and ice stop rod 5 that are inclined from the horizontal to facilitate further movement of ice pieces through the holding vessel 2 and out the aperture thereof. The ice stop rod 5 operates to stop the ice from moving too far into the inclined second transport mechanism, and when the ice mass is sufficiently adjacent to the second transport mechanism the ice stop rod 5 can be operatively associated with a trigger to an ice stop limit switch 6, which turns off the substantially horizontal motion of the ice transferring device 3, i.e., the first transport mechanism. The ice rake chain 4 rakes the ice downward towards the horizontal auger 9, either concurrently or sequentially with the substantially horizontal movement of the mass, or both, as needed to transport sufficient ice from the holding vessel 2 to the second holding vessel 20. The ice rake chain 4 and an optional support member to maintain it at a preselected inclined level may be disposed at different angles, but is preferably fixed at about 40 degrees to about 80 degrees from the horizontal, more preferably from about 50 to 70 degrees from the horizontal. A motor 8 is preferably operatively associated with the ice rake chain 4, the substantially horizontal auger 9, or both. The second transport mechanism, such as an ice rake chain 4 and ice stop rod 5, is typically enclosed within the insulation chamber 210 and preferably a portion thereof is present in the holding vessel 2.

Optionally, but preferably, a substantially horizontal auger 9 is configured and dimensioned to receive ice pieces from the holding vessel 2 and facilitates transport thereof to a second holding vessel, such as auger box 20, which can have a lid and optionally a limiting switch operatively associated therewith. The second holding vessel is generally sized and dimensioned to contain sufficient ice pieces to fill a container being purchased by the consumer, which second holding vessel is readily refilled from the holding vessel 2 as soon as the sufficient amount of ice pieces is removed therefrom. As the auger box 20, for example, fills with ice pieces, the optional hinged, pivotable lid is pushed upwards toward the top until it is fully opened or until an optional limit switch 11 stops the substantially horizontal auger 9 from further filling the auger box 20 with ice. From the auger box 20, the ice is generally transported to the weighing device 21, such as by the upwardly directional transport device 12. As can be seen from FIG. 1, the ice transferring device 3, horizontal auger 9, and auger box 20 are preferably enclosed within the insulation chamber 210.

By "substantially horizontal" is meant a horizontal distance across a portion of the holding vessel 2 is traversed by a plurality of the ice pieces before they exit the holding vessel 2 via an aperture 11. "Substantially" includes completely horizontal and can also mean, for example, that the ice generally moves at an average angle of no more than about 20 degrees, and preferably no more than about 10 degrees, from the horizontal, either above or below horizontal. Preferably, substantially horizontal can mean about 0.1 to 8 degrees, more preferably from about 0.2 to 5 degrees from the horizontal. In a most preferred embodiment, the angle from the horizontal is from about 0.5 to 3 degrees. Preferably, the ice pieces move in a flat or slightly downward direction during the substantially horizontal component of their transport to the aperture. A motor 7 is preferably operatively associated with the ice transferring device 3, as well as various other devices of the invention further described herein, to facilitate the rapid delivery of ice pieces to the consumer. Suitable motor size and power for any of the mechanized features of the invention herein will be readily determined by one of ordinary skill in the art with reference to the description of the invention herein.

In one embodiment, the ice transferring device 3 tilts a portion of the holding vessel 2 to facilitate transport of the ice pieces substantially horizontally to the aperture 11. In this embodiment, such a tilting mechanism can be operatively associated with the bottom surface of the holding vessel to reversibly raise an end of the bottom surface to facilitate transfer of the ice pieces out of the holding vessel 2, and an upwardly directional ice transport device 12 operatively positioned at a second end opposite the reversibly raised end of the bottom surface, which conveys the ice upwards to a weighing device 21, whereby the weighing device 21 meters out a portion of ice pieces and deposits the portion into a readily transportable container. The bottom surface of the holding vessel 2 can be raised to an inclined position, or alternatively a portion of the bottom surface, the entire holding vessel 2, or a second bottom adjacent and above the bottom surface, can be raised to an inclined position. Optionally, but preferably, a second transport mechanism, such as an ice rake chain 4 and ice stop rod 5, can be included to facilitate movement of ice as described above for the preferred embodiment. Other suitable devices to substantially horizontally transport the ice pieces to and through aperture 11 can be used, as well.

Aperture 11 may be located on the side or bottom of holding vessel 2, or both, i.e., the aperture may extend across a portion of one or more sides, a side and the bottom, or a combination thereof. The aperture 11 typically is configured and dimensioned so that blockage of the ice flow is minimized or avoided, so that sufficient ice can pass through the aperture sufficiently rapidly to minimize waiting time by the consumer, and so that ice pieces are directed into or onto an optional, but preferably present, upwardly directional ice transport device 12. This ice transport device 12 is operably positioned and configured to receive as many ice pieces as possible from the aperture. Ice pieces can exit the aperture and are retained and transported by the upwardly directional ice transport device 12. This device 12 can include any suitable device that can move ice pieces in an upwardly direction in automated fashion, including an auger, a conveyor belt, a scoop or bucket type device that has sufficiently sized or numbered scoops or buckets on a belt or chain to raise a sufficient amount of ice pieces, or the like, or any combination thereof. A motor 10 is preferably associated with the operation of the ice transport device 12 to expedite delivery of ice pieces to the consumer. In the FIG. 1 depiction, the upwardly directional ice transport device includes an inclined auger 12 that brings a portion of the ice pieces to a weighing device 21. The inclined auger 12 is preferably a closed tube. The diameter of the inclined auger 12 may be from about 1 inch to 7 inches, preferably about 2 inches to 5 inches. The inclined auger 12 is preferably not enclosed entirely by the insulation chamber 210, but is disposed partly on either side thereof.

Advantageously, the upwardly directional transport device 12 functions to separate the melted ice, or runoff water, from the ice pieces. This runoff is shunted aside or otherwise separated from the ice pieces, such as by gravity, and preferably directed into a drain, onto the ground, or otherwise away from the apparatus to minimize rusting or other degradation or damage to the apparatus of the invention or to the still frozen ice pieces in the holding vessel 2. The ice pieces, which were optionally first upwardly directed, are then disposed on or in a weighing device 21. The weighing device 21 may include any mechanism available to those of ordinary skill in the art that is suitable for weighing ice pieces. For example, the weighing device 21 might include a load cell, pressure plate, strain gauge, displacement device such as one that displaces a pre-measured quantity of fluid, or the like. After weighing, the apparatus includes a container chute 14 though which the ice pieces are disposed and are directed into waiting transportable containers 17.

The containers 17 used to capture ice pieces from the apparatus are preferably readily transportable so that consumers may easily transport the ice where desired. Thus, although the term "bagged ice" is used herein, it should be understood that any of a variety of readily transportable containers may be used so long as they can support the weight of the portion of ice to be delivered therein. Readily transportable containers 17 can thus include bags, coolers, boxes, drums, trash cans, kegs, or the like, any of which can be stacked within the apparatus of the invention, filled with the desired amount of ice pieces by weight, sufficiently sealed to inhibit escape of ice pieces until the container is desired to be opened, and delivered to the consumer. Preferably, the container 17 includes one or more handles to facilitate a consumer's grasp thereof, such as extending from, recessed in, or integrally formed with the container 17. A preferred container 17 includes an ice bag 17, which is typically made of one or more fabric or thermoplastic materials. Conventional ice bags may also be used. Preferably, the readily transportable container 17 exists fully formed within the apparatus of the invention and contains only a single opening, which can be readily sealed in a manner sufficient to minimize or prevent the loss of ice pieces.

In a preferred embodiment, the containers 17 include preformed bags 17 that are pre-sealed one end, typically a bottom end that is lower than an open upper end. The open end of each container 17 is preferably opened before, or concurrently with, ice pieces being weighed on the weighing device 21 so that each container 17 is ready for the pre-measured portion of ice pieces to be disposed therein. The ice pieces are typically disposed by gravity from the weighing device 21 into each container 17, such as by tilting the weighing device 21 or opening an aperture in a lower portion of the weighing device 21. The container 17 below the weighing device 21, if not already opened, is preferably blown open by a fan 18, although any suitable mechanism to open the containers or bags may be included. Preferably, a positioning device 15 pulls the filled container into a closing device 16. The positioning device 15 is positioned and configured to pull, push, or otherwise transfer each container from a container supply (not shown) into position for receiving a weighed portion of ice pieces. An exemplary positioning device is a grabbing arm. Another suitable positioning device can hold the sides of each container adjacent the top, optionally pulling a portion of the container 17 by vacuum to facilitate opening the container 17. When rigid, self-supporting containers like foam or plastic coolers are the containers, the positioning device 15 can include a conveyor belt or a rotating supply device to place the containers in position to receive weighed ice pieces.

The closing device 16 seals the bag or other container using any available fastener, including staples, ties (wire, plastic, etc.), heat sealing, adhesive, or the like. Preferably, the closing device 16 operates without use of adhesive or heat sealing, which can affect the ice pieces such as by contaminating them with chemicals from the adhesive or a melted portion of the container. In a more preferred embodiment, the closing device is a bag tier 16 that ties off the open end of each container 17 sufficiently to minimize or avoid loss of ice pieces from the container 17. The ties can include any suitable tie material, such as wire, plastic, paper, fabric, or the like, or any combination thereof. The containerized ice pieces then optionally, but preferably, drop down a container slide 19 for retrieval by the consumer. The containers may be provided where consumers can view the ice being disposed therein and seeing the container 17 being sealed as a novelty to entertain the consumer while containerizing and delivering the ice, however, it is typically desired to provide only a finished product, i.e., sealed container 17, to the consumer and to avoid or minimize exposure of parts of the apparatus outside the vending device to inhibit or avoid vandalism or other accidental breakage of such parts.

Heat sealing is preferably avoided for sealing the containers 17, as it poses the risk of melting a portion of the ice pieces, causes the ice pieces to aggregate together, or both. The containers 17 are preferably closed by use of a staple tie or wire that folds around the open end of the container. Any suitable staple ties or wires can be used that will sufficiently seal the container 17. Preferably, the staple ties or wires are about 0.5 to 3 inches long. A one inch staple is exemplary. Rolls of staples or wire can be provided in association with a motorized device to separate the staples or cut the wire to a suitable length, and then positioned and folded around the open end of a container to sufficiently seal it. A staple machine that can be included in the apparatus is commercially available through Hamer of St. Louis Park, Mo. Another advantage of providing fresh-bagged ice that is secured by tying, such as by staples, is that securing the bag in this way permits the containers to be readily opened by removal of the tie, yet remain completely resealable with the same tie or another closure device such as a plastic, metal, or paper twist tie to which consumers typically have ready access.

Figure 2:
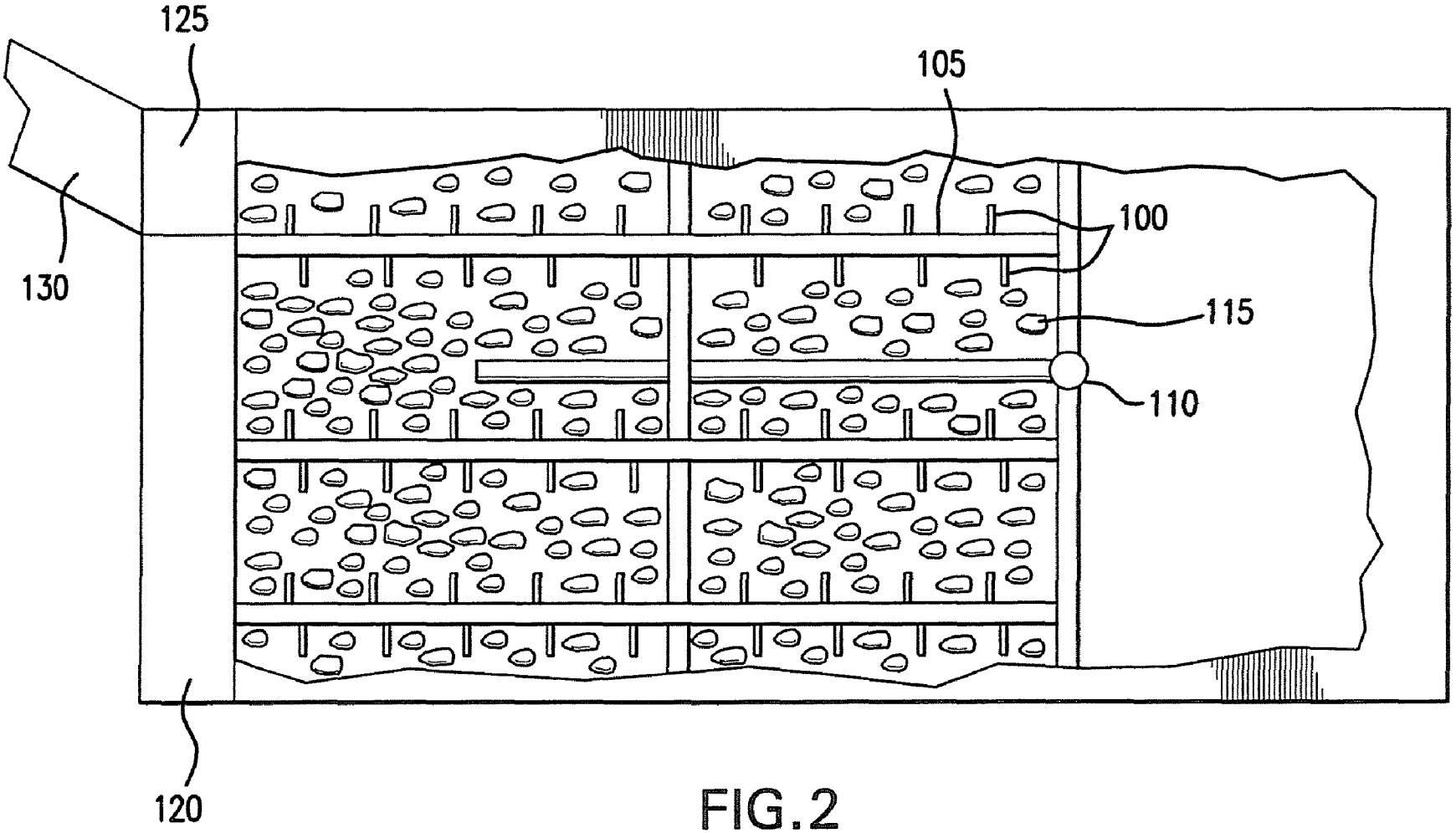
FIG. 2 shows a top view of the holding vessel and the inclined portion of the ice transferring device according to the invention.

The top view of a preferred embodiment of the present invention is illustrated in FIG. 2. As can be seen in FIG. 2, a plurality of projections 100 that can be independently vertical, horizontal, or angled therebetween, can be included that extend across a portion of an inclined surface of the holding vessel to facilitate transport of ice pieces 115 toward the aperture. A similar set of projections can be disposed adjacent the base of the holding vessel 2 along the first transport mechanism 22 (not shown in FIG. 2) disposed along the length thereof that facilitates the substantially horizontal movement of the ice pieces. Preferably, the projections 100 are not disposed along the direction of travel, but project vertically outwards and downwards at an angle to contact the ice pieces and facilitate transfer such as by scraping or knocking ice pieces from an edge of the ice piece mass downwards to the aperture. The second transport mechanism is optional but preferable, and when present in the invention includes projections 100 that are preferably attached to a mechanized device that can operate in continuous fashion, such as ice rake chain 105 that loops around. Preferably, the lower part of the second transport mechanism is closer to the ice so that the upper part is further away and traveling upwards as the continuous loop returns to the top of the holding vessel. Ice stop rod 110 operates to stop the movement of ice substantially horizontally towards the inclined second transport mechanism to prevent buildup of ice in or about the second transport mechanism. The optional, but preferable, substantially horizontal auger 120 can thereafter transport the ice pieces to the second holding vessel, such as an auger box 125, where an optional but preferable upwardly directional ice transport device 130 can transport the ice pieces to the weighing device.

Figure 3:
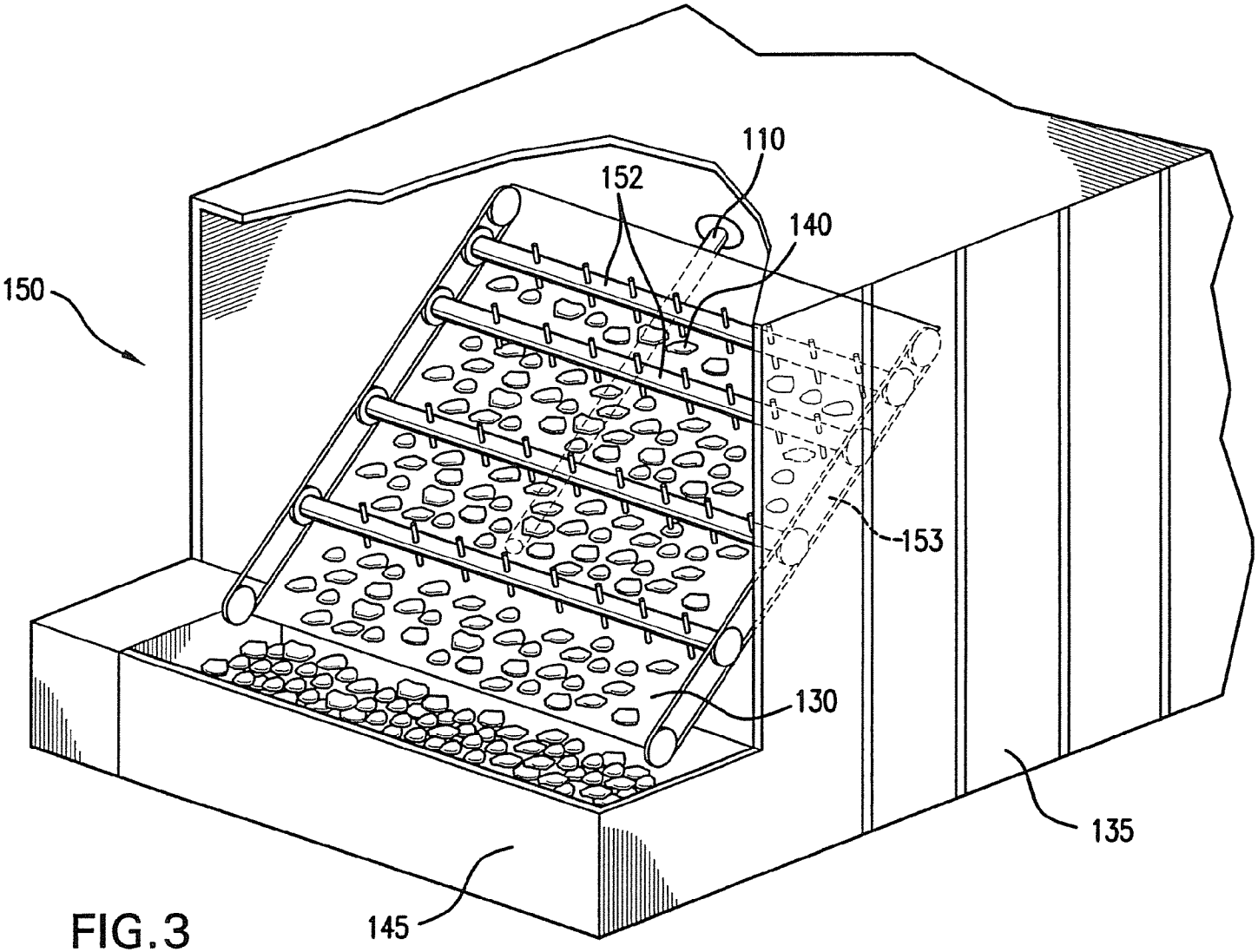
FIG. 3 shows a side view of the transport mechanism of the holding vessel according to the invention.

Referring to FIG. 3, it can be seen that the second transport mechanism 153 is disposed differently from FIG. 2, with a continuous loop either rotating the bars 152 or with the bars 152 fixed on the loop and moving downwards adjacent the ice pieces 140 and returning at the upper part of the loop portion further away from the ice pieces. The second transport mechanism is typically angled at about 30 degrees to 80 degrees from the horizontal to receive ice pieces 140 from the first transport mechanism that has moved the ice pieces in a substantially horizontal direction to facilitate transport of a portion of the ice pieces 140 out of the holding vessel 135 into the horizontal auger 145 or other device that receives ice pieces 140 from the aperture 150. As shown, the aperture in FIG. 3 is the entire end wall of the holding vessel 135 that is open, although various smaller or larger apertures can be used. Preferably, the aperture is smaller and sized sufficiently to retain ice while permitting sufficient ice through the aperture while the ice transferring mechanism is in operation.

Figure 4:
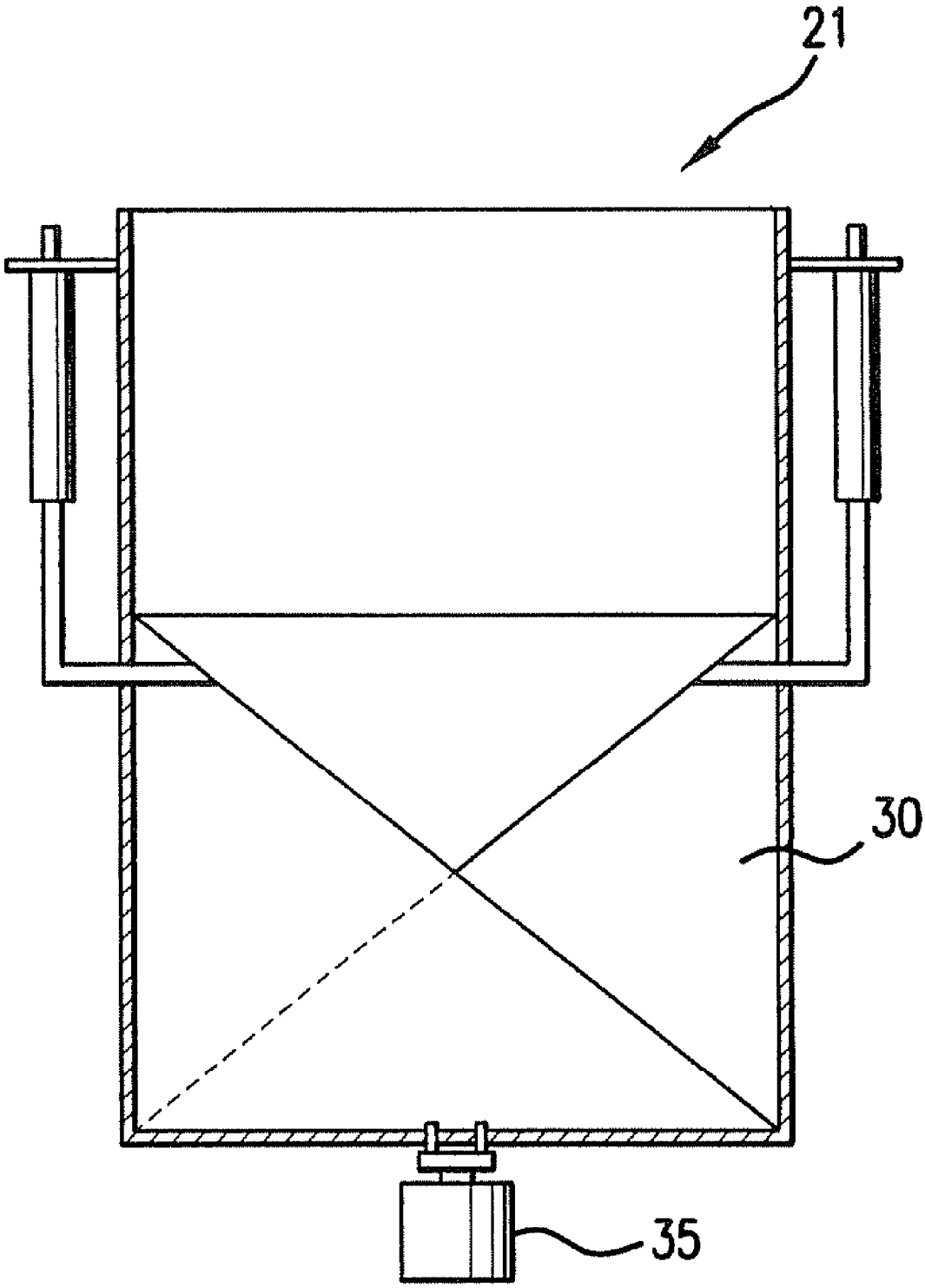
FIG. 4 shows a weighing device for weighing ice pieces according to the invention.

FIG. 4 shows an exemplary ice weighing device 21 in more detail. In one embodiment, the load cell box 30 is sized and configured to receive a sufficient amount of ice pieces to fill a single container, e.g., about 12 inches by about 12 inches by about 9 inches. Any suitable dimensions will work, although preferably the load cell box 30 size is sufficient to contain the desired amount of ice pieces to completely fill any desired size transportable container 17. A load cell 35 is operatively associated with the weighing device 21 to meter out the pre-selected amount of ice pieces. Once the load cell 35 measures that sufficient ice pieces are present in the load cell box 30 to meet the pre-selected weight, the supply of ice pieces from the holding vessel and other portions of the device is terminated. Preferably simultaneously, the ice pieces are released from the load cell box 30 for further processing, typically directly into a container that is to be sufficiently closed and delivered to the consumer. Any suitable mechanism can be used to do so, such as an electric solenoid that releases a reversibly pivotable bottom of the load cell box 30 to drop the ice pieces by gravity into a waiting container.

Figure 5:
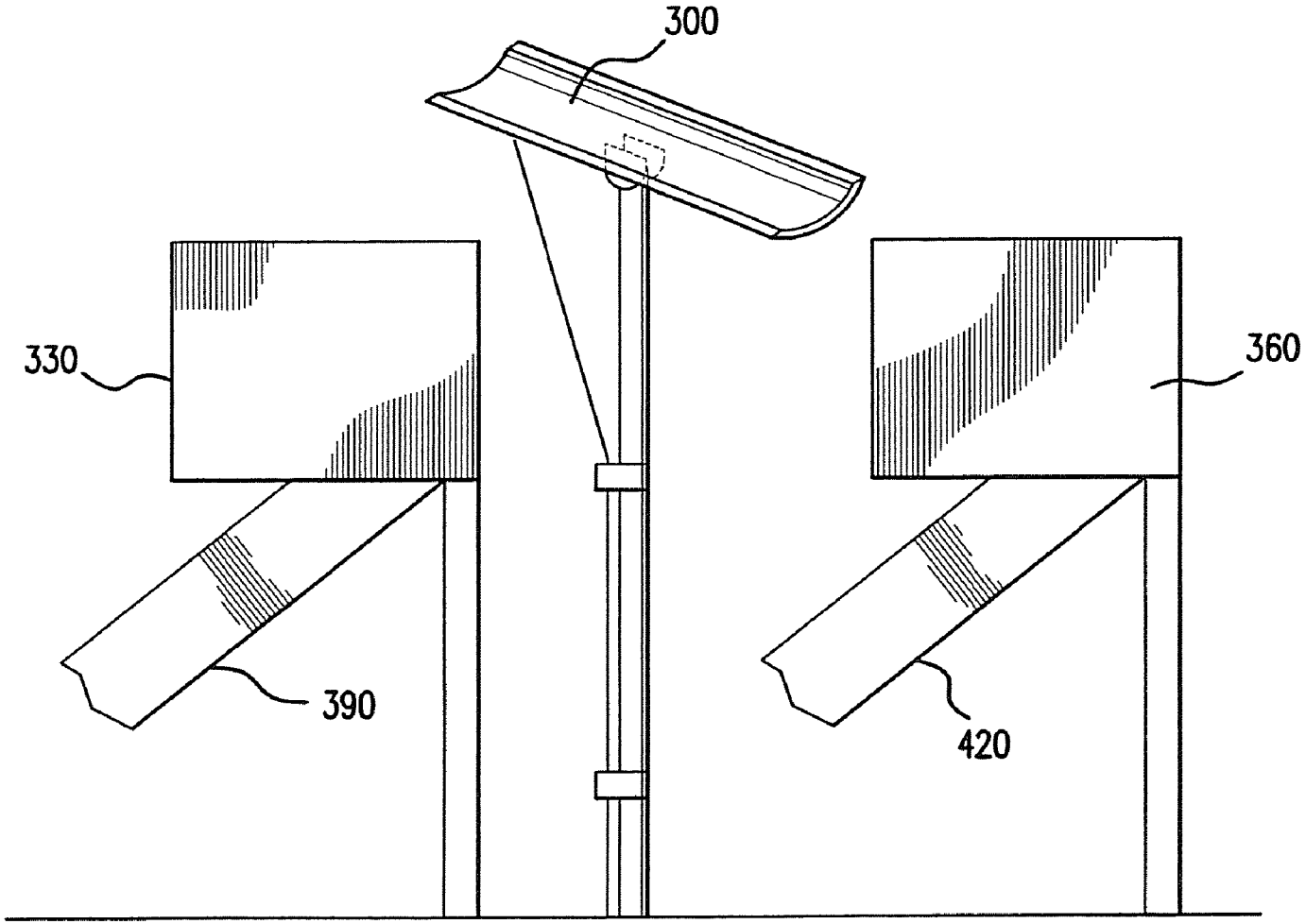
FIG. 5 shows another embodiment of the weighing device according to the invention.

FIG. 5 shows another preferred embodiment of the ice weighing device. This weighing device includes two ballast boxes 330 and 360 and a pivotable slide 300. This permits the apparatus to more simply deliver two different amounts of ice pieces. Depending on whether the consumer chooses the ice in bag or bulk, for example, the slide 300 can be pivoted such as hydraulically towards the ballast box 330 or 360 that corresponds to the pre-selected size container. For example, if the consumer chooses bagged ice of 16 pounds, the slide 300 will pivot towards the box 330, which is ballasted or counterbalanced with 16 pounds of weight to tip over or otherwise release the ice pieces into a waiting, open container as soon as 16 pounds of ice pieces are delivered therein. If the consumer chooses ice in bulk, the slide 300 will be pivoted towards the other box 360, which is counterbalanced with 20 pounds of weights to tip or otherwise release the ice into a waiting container as soon as 20 pounds of ice is present in the box 360. The ice pieces travel down a chute 390, 420 corresponding to the ballast box and type of container they are to be delivered into. If the consumer chooses bagged ice, then the slide 300 pivots towards the box 330, travels down chute 390, and is transported to the bagging and tying mechanism. If the consumer chooses bulk ice, then the slide 300 pivots towards the box 360 and the ice travels down another chute 420 to the waiting consumer with a consumer-supplied container, such as a cooler, in hand or resting beneath the chute.

Figure 6:
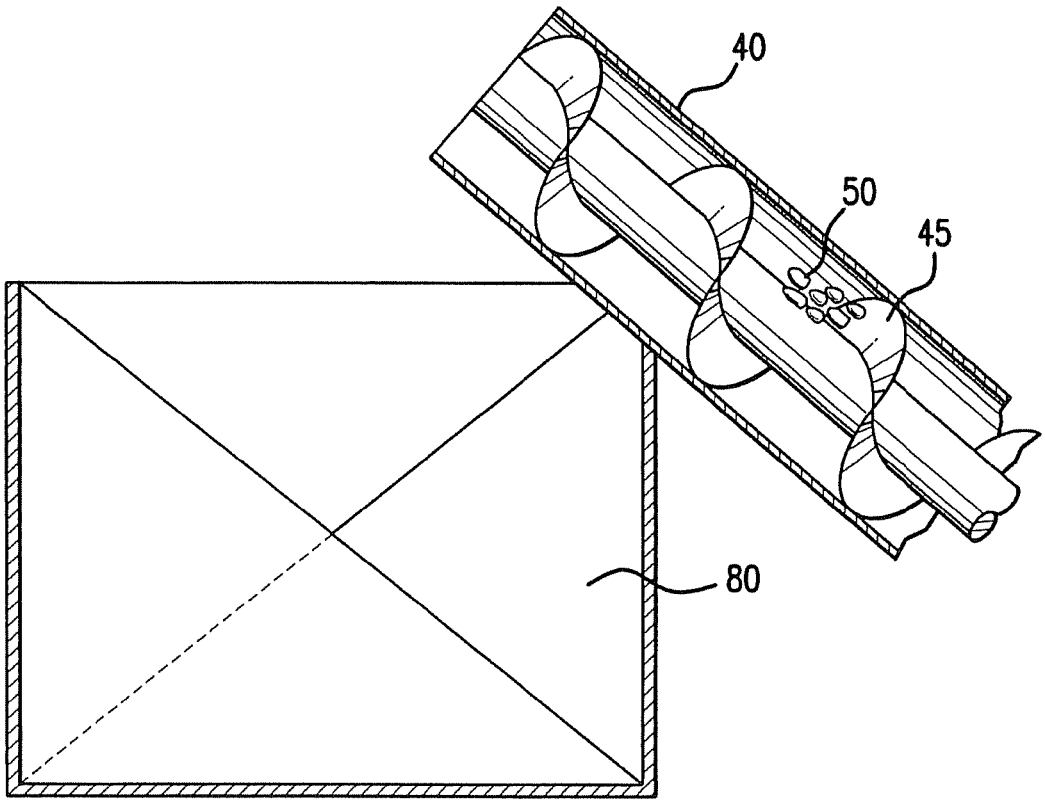
FIG. 6 shows an upwardly directional ice transport device according to the invention.

FIG. 6 illustrates an inclined auger 40 having a plurality of grooves, or screw threads 45, that operate to bring a portion of ice pieces 50, typically upwardly to a weighing device 80, which can either be a single load cell box or a pair of ballast boxes, as described herein, or any other suitable weighing device.

Figure 7:
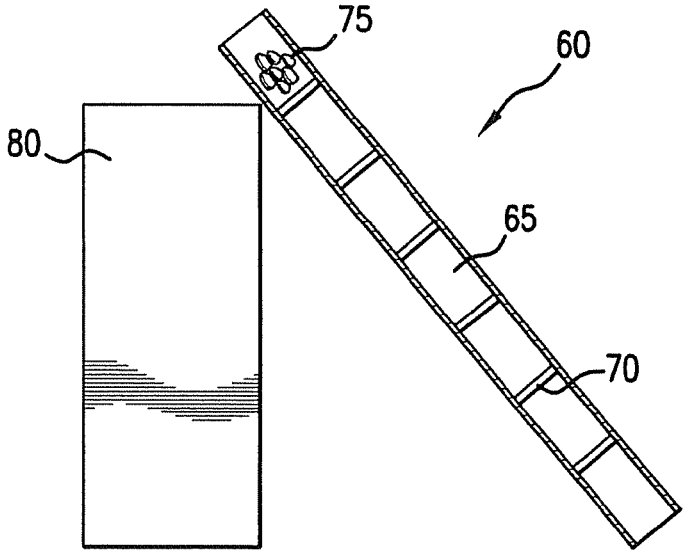
FIG. 7 shows another embodiment of the upwardly directional ice transport device according to the invention.

FIG. 7 illustrates a conveyer belt-type device 60 with a plurality of compartments 65 formed from a plurality of dividers 70 that carry a portion of the ice pieces 75 to a weighing device 80. In one embodiment, each compartment 65 is sized and configured to receive and transport sufficient ice pieces to fill a single container 17 (not shown). The compartments 65 may alternatively be spaced as one of ordinary skill in the art determines is suitable for carrying ice pieces 75 upwards to the weighing device 80.

Figure 8:
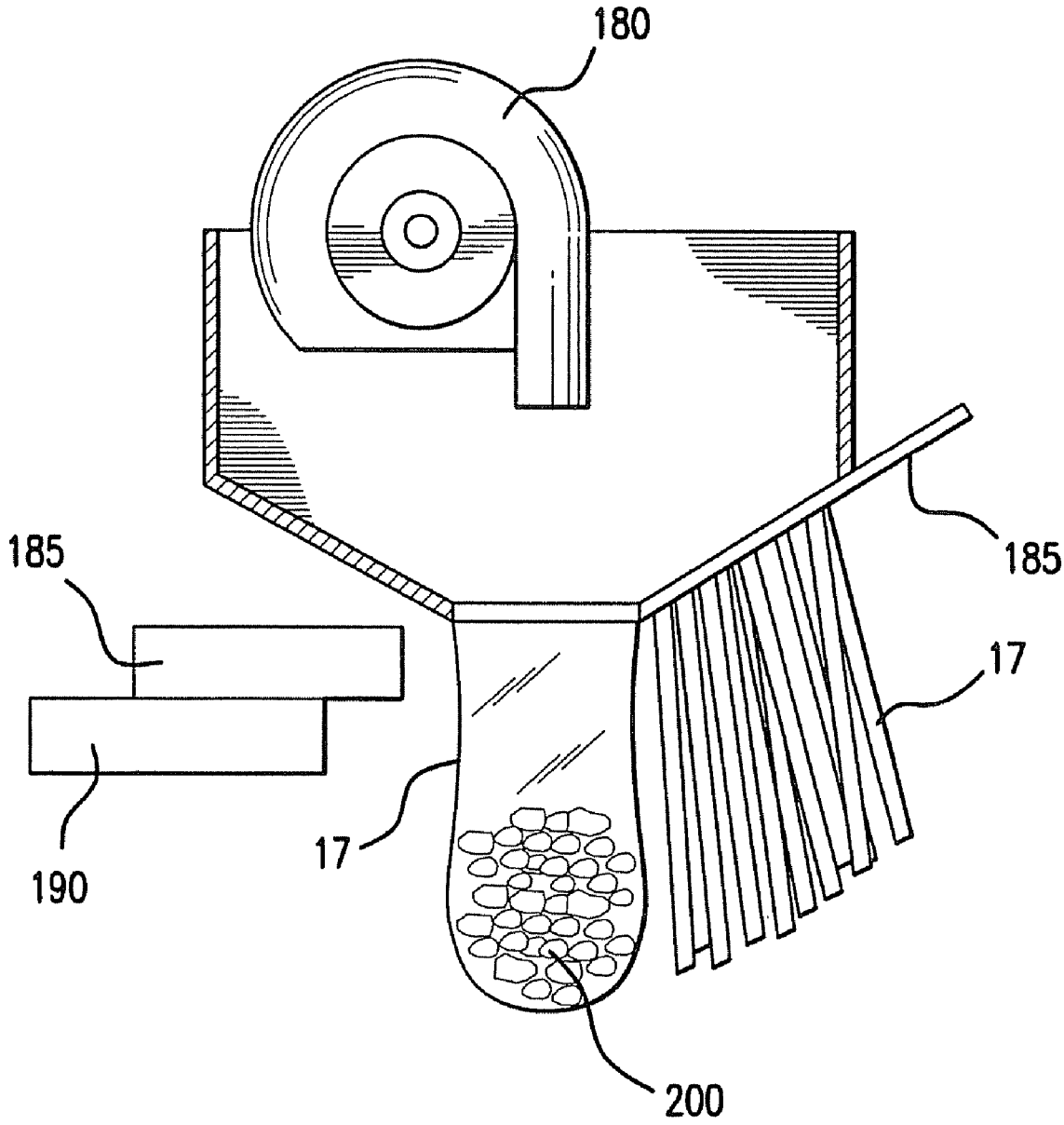
FIG. 8 shows a bagging and closing mechanism according to the invention.

Referring to FIG. 8, the individual components that bag the pre-measured ice pieces 200 and subsequently secure the sufficiently filled, readily transportable container 17 are readily seen. These include: a fan 180 to facilitate opening the containers 17 so the ice pieces 200 may be deposited therein, a container positioning device 185 to move each container 17 one at a time from its initial, stored position to a receiving position into which ice pieces 200 can be disposed from the weighing device (not shown), and a container securing device 190 that secures the readily transportable containers 17 sufficiently to minimize or avoid loss of ice pieces 200 from the secured container. In operation, for example, the fan 180 can blow the container 17 open at about the same time as the positioning device 185 pulls the container 17. It can be seen that a portion of the positioning device can include a static frame, such as wire rack, that supports containers and directs them adjacent an ice receiving zone under the weighing device adjacent the fan 180. The positioning device 185 and fan 180 work in conjunction and are operatively associated. The movable part of the positioning device 185 that makes contact with the container 17 may contain a plurality of holes, where a vacuum may be used to bring the container 17 to a position to receive ice. Optionally, the positioning device 185 may have an adhesive pad that pulls the container 17 into a position to receive ice. In either situation, or for all other suitable types of positioning devices, it is preferred that the positioning device move one side of a container sufficiently away from the other one in the static frame 185 opposite the movable part for ice pieces to fall therein. In one embodiment, the ice pieces fall quickly and gravity immediately pulls the container 17 from the positioning device down a chute positioned underneath it. This permits ice to be delivered quite rapidly to the consumer, who in one embodiment may tie the container with bag ties that are conveniently placed adjacent to the ice delivery location. In this embodiment, the containers are sufficiently large to inhibit or prevent any significant amount of ice pieces from escaping the container before it is delivered to the consumer, such as at the bottom of a container chute.

The automated ice vending apparatus of the invention advantageously containerizes ice, such as by "bagging," in rapid succession so that consumers do not need to wait long for the product being purchased. In a preferred embodiment, the entire process of taking ice pieces from the holding vessel, or storage zone, transporting the portion as needed, weighing it, and disposing it into a readily transportable container, and delivering that container to a consumer, takes about 4 to 20 seconds, preferably about 5 to 15 seconds. The ice vending apparatus operates 24-hours a day with no interruptions. A remote monitoring device can be provided that is operatively associated with the payment device, the water supply, the container supply, or a combination thereof to ensure smooth operation. For example, a central station can be notified electronically or telephonically that part of the device is out of order so that replacements or a repair technician can be dispatched. Thus, the supply of containers should never run out, and sufficient change, if needed, can always be present in the apparatus to facilitate 24-hour operation.

EXAMPLE

The following example is not intended to limit the scope of the invention, but merely to illustrate representative possibilities concerning the present invention.

Example 1

An Automatic Ice Vending Apparatus According to the Invention

The accompanying FIG. 1 illustrates an exemplary automatic ice vending apparatus 205 constructed according to the present invention. The entire vending apparatus 205 was 24 feet in length, 8 feet across, and was 8 feet, 6 inches tall. An holding vessel 2, or storage bin, was constructed of stainless steel having a length of 9 feet, a height of 5 feet. The storage bin was mounted on a frame to raise the holding vessel sufficiently above the substrate or ground so that the at least substantially horizontal auger, auger box, and an inclined auger 12 could be properly positioned below the aperture of the holding vessel 2. The frame included a plurality of beams and bars for reinforcement so the holding vessel 2 could hold a large supply of ice pieces, e.g., up to 20,000 pounds with a typical load of about 9,000 pounds. The other components of the apparatus—the ice making device 1, inclined auger 12, ice transferring device 3, ice weighing device 21, and transport, bagging and closing mechanisms—were individually assembled and combined to form the ice vending apparatus 205. A suitable coin validator and 16- and 20-pound selection buttons are disposed outside the apparatus 205 and operatively associated with the components therein.

The term "about," as used herein, should generally be understood to refer to both numbers in a range of numerals. Moreover, all numerical ranges herein should be understood to include each whole integer within the range.

Although preferred embodiments of the invention have been described in the foregoing description, it will be understood that the invention is not limited to the specific embodiments disclosed herein but is capable of numerous modifications by one of ordinary skill in the art. It will be understood that the materials used and the mechanical details may be slightly different or modified from the descriptions herein without departing from the methods and devices disclosed and taught by the present invention.

What is claimed is:

1. An automated ice vending apparatus, comprising:

a holding vessel formed with an aperture, the holding vessel being configured and dimensioned to receive and house ice pieces produced by an operatively associated ice supply;

a container filling station; and an ice transferring device at least partially disposed within the holding vessel, with the ice transferring device facilitating movement of ice pieces located therein in a first direction toward and through the aperture thereof, and in a second different direction to the container filling station where a selected quantity of ice pieces is placed into a readily transportable container, wherein the container filling station comprises a metering device that is operatively associated with the ice transferring device and that meters a selected quantity of ice pieces into each readily transportable container, wherein the ice transferring device further comprises a second holding vessel having at least one end positioned to receive ice pieces emitted from the aperture; a first transport device located within the second holding vessel to move ice pieces toward the end thereof; and a second transport device positioned between the end of the second holding vessel and the container filling station to move ice pieces from the second holding vessel to the container filling station.

2. The automated apparatus of claim 1, wherein the second different direction itself comprises two different directions that are different from the first direction.

3. The automated apparatus of claim 2, wherein the first transport device moves the ice pieces laterally from the aperture toward the second transport device.

4. The automated apparatus of claim 1, wherein the aperture extends across a portion of a side of the holding vessel so as to facilitate movement of ice pieces adjacent the first transport device.

5. The automated apparatus of claim 1, wherein the apparatus is configured and adapted to deliver an ice-filled container to a purchaser within a time period in the range of about 4 seconds to 20 seconds from the time of receipt of payment.

6. The automated apparatus of claim 1, wherein the first direction is angled no more than about 20 degrees from the horizontal.

7. The automated apparatus of claim 1, wherein the metering device comprises a weighing device located vertically above the aperture, the second direction being upwardly angled between the aperture and the weighing device.

8. The automated apparatus of claim 1, wherein the ice supply is configured and adapted to deposit ice pieces into the holding vessel to replenish a portion of ice pieces removed through the aperture.

9. The automated apparatus of claim 1, wherein the readily transportable container is a fully formed, discrete, plastic bag including an open end in which to dispose the selected quantity of ice pieces and a second permanently closed end.

10. The automated apparatus of claim 9, further comprising a fan that operates to blow open the open end of the bag to facilitate disposing ice pieces therein.

11. The automated apparatus of claim 9, further comprising a positioning device configured and adapted to position the bag so the open end can receive ice pieces.

12. The automated apparatus of claim 9, further comprising a closing device configured and adapted to releasably fasten each open end to seal each bag.

13. The automated apparatus of claim 1, further comprising a downwardly angled surface associated with the ice metering device to facilitate delivery of each container therefrom to a consumer.

14. The automated apparatus of claim 1, wherein the apparatus is configured and adapted to deliver a substantial quantity of automatically bagged ice pieces in rapid succession by providing at least 100 readily transportable containers in no more than about 30 minutes.

15. The automated apparatus of claim 1, wherein the first direction includes a substantially horizontal component and a downwardly angled component relative to the vertical.

16. The automated apparatus of claim 1, wherein the metering device weighs the ice pieces to provide the selected quantity of ice pieces.

* * * * *